US009170547B2

(12) United States Patent
Mori

(10) Patent No.: US 9,170,547 B2
(45) Date of Patent: Oct. 27, 2015

(54) IMAGE FORMING APPARATUS

(71) Applicant: Hirotaka Mori, Nagoya (JP)

(72) Inventor: Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 160 days.

(21) Appl. No.: 13/748,686

(22) Filed: Jan. 24, 2013

(65) Prior Publication Data

US 2013/0189014 A1 Jul. 25, 2013

(30) Foreign Application Priority Data

Jan. 25, 2012 (JP) ..... 2012-013289

(51) Int. Cl.
*G03G 15/00* (2006.01)
*G03G 21/00* (2006.01)
*G03G 15/01* (2006.01)

(52) U.S. Cl.
CPC ..... *G03G 15/6552* (2013.01); *G03G 15/0194* (2013.01); *G03G 15/657* (2013.01)

(58) Field of Classification Search
CPC ..... G03G 15/00; G03G 21/00; G03G 21/06; G03G 21/16; G03G 15/6552; G03G 15/0194; G03G 15/657
USPC ..... 399/397–400
See application file for complete search history.

(56) References Cited

U.S. PATENT DOCUMENTS 5,081,504 A * 1/1992 Morisawa et al. ..... 399/350
5,974,277 A 10/1999 Yamane et al.
6,094,554 A 7/2000 Ichikawa et al.
6,128,460 A * 10/2000 Ito et al. ..... 399/303
6,151,474 A 11/2000 Ichikawa et al.
6,163,674 A 12/2000 Ichikawa et al.
6,192,209 B1 2/2001 Ichikawa et al.
6,198,893 B1 3/2001 Ichikawa et al.
6,226,484 B1 5/2001 Ichikawa et al.

(Continued)

FOREIGN PATENT DOCUMENTS

JP 63-083775 A 4/1988
JP 06-258957 A 9/1994

(Continued)

OTHER PUBLICATIONS

Jan. 30, 2005—(JP) Notice of Reasons for Rejection—App2012013289—Eng Tran.

(Continued)

*Primary Examiner* — Nguyen Ha
(74) *Attorney, Agent, or Firm* — Banner & Witcoff, Ltd.

(57) ABSTRACT

An image forming apparatus, comprising: a main body, at least one photosensitive drum, a transfer belt provided in the main body to form a conveying surface; a fixing unit; and an antistatic member configured to suppress detachment discharge caused when a sheet-like medium is detached from the transfer belt, wherein the antistatic member is situated in the main body at a position on a downstream side of the at least one photosensitive drum and on an upstream side of the fixing unit along the conveying path, wherein the at least one photosensitive drum is held on a photosensitive drum holding body configured to be detachably attachable to the main body; and the antistatic member is provided for the at least one photosensitive drum holding body on a downstream side with respect to a contact position between the at least one photosensitive drum and the sheet-like medium.

20 Claims, 6 Drawing Sheets

(56) References Cited

U.S. PATENT DOCUMENTS

| | | | | |
|---|---|---|---|---|
| 6,226,486 | B1 | 5/2001 | Itou et al. | |
| 6,240,264 | B1 * | 5/2001 | Yajima et al. | 399/82 |
| 6,266,498 | B1 * | 7/2001 | Oda et al. | 399/92 |
| 6,295,433 | B1 | 9/2001 | Ichikawa et al. | |
| 6,434,344 | B1 * | 8/2002 | Yoshida et al. | 399/44 |
| 2001/0026716 | A1 * | 10/2001 | Ishikawa | 399/315 |
| 2002/0057933 | A1 * | 5/2002 | Ebihara et al. | 399/303 |
| 2003/0202830 | A1 * | 10/2003 | Oh et al. | 399/390 |
| 2004/0091276 | A1 * | 5/2004 | Yoshida et al. | 399/38 |
| 2006/0067734 | A1 * | 3/2006 | Igarashi et al. | 399/119 |
| 2007/0147858 | A1 * | 6/2007 | Inukai | 399/31 |
| 2008/0025767 | A1 * | 1/2008 | Takagami | 399/313 |
| 2008/0267657 | A1 * | 10/2008 | Mori | 399/101 |
| 2010/0080614 | A1 * | 4/2010 | Yamaguchi et al. | 399/111 |
| 2010/0239271 | A1 * | 9/2010 | Kawamura et al. | 399/21 |
| 2011/0200355 | A1 * | 8/2011 | Mori et al. | 399/110 |
| 2012/0148288 | A1 * | 6/2012 | Okabe et al. | 399/90 |

FOREIGN PATENT DOCUMENTS

| | | | | | |
|---|---|---|---|---|---|
| JP | 09-068871 | A | | 3/1997 | |
| JP | 10-240009 | A | | 9/1998 | |
| JP | 10-333446 | A | | 12/1998 | |
| JP | 11-084906 | A | | 3/1999 | |
| JP | H1195530 | A | | 4/1999 | |
| JP | H11149223 | A | | 6/1999 | |
| JP | 11-288137 | A | | 10/1999 | |
| JP | 11327317 | A | * | 11/1999 | G03G 15/16 |
| JP | 2002-169352 | A | | 6/2002 | |
| JP | 2005-003731 | A | | 1/2005 | |
| JP | 2007-298768 | A | | 11/2007 | |
| JP | 2009-015176 | A | | 1/2009 | |

OTHER PUBLICATIONS

Feb. 3, 2015—(JP) Notice of Reasons for Rejection—App2012013289—Eng Tran.

* cited by examiner

IMAGE FORMING APPARATUS

CROSS-REFERENCE TO RELATED APPLICATION

This application claims priority under 35 U.S.C. §119 from Japanese Patent Application No. 2012-013289, filed on Jan. 25, 2012. The entire subject matter of the application is incorporated herein by reference.

BACKGROUND

1. Technical Field

Aspects of the present invention relate to an image forming apparatus.

2. Related Art

Image forming apparatuses including a main body, a photosensitive drum, a transfer belt, a fixing unit and an antistatic member have been used. In the main body of the image forming apparatus, a convey path for conveying a sheet-like medium is provided. The photosensitive drum is provided in the main body and is able to hold a toner image thereon. The transfer belt is also provided in the main body. The transfer belt forms a conveying surface which is a part of the conveying path and holds the sheet-like medium on the photosensitive drum side, and transfers the toner image to the sheet-like medium while holding the sheet-like medium to be able to contact the photosensitive drum. The fixing unit fixes the toner image on the sheet-like medium. The antistatic member is provided in the main body so as to suppress detachment discharge which would occur when the sheet-like medium is detached from the transfer belt.

However, if the above described image forming apparatus is used for a long period of time, paper jam may occur on the conveying path and in this case toner on the sheet-like medium may adhere to the antistatic member. Furthermore, in the above described image forming apparatus, the adhering force of toner with respect to the sheet-like medium becomes weak depending on use environments or conditions of the sheet-like medium, and in this case the toner may scatter and thereby the toner may adhere to the antistatic member.

In this regard, since the antistatic member is fixed to the main body in the above described image forming apparatus. Therefore, the toner may continue to adhere to the antistatic member, and thereby the antistatic member may become unable to sufficiently suppress the detachment discharge. In this case, disturbance may occur in an image on the sheet-like medium

SUMMARY

Aspects of the present invention are advantageous in that they provide an image forming apparatus capable of forming a high-quality image on a sheet-like medium even if the image forming apparatus is used for a long period of time.

According to an aspect of the invention, there is provided an image forming apparatus, comprising: a main body in which a conveying path along which a sheet-like medium is conveyed is provided; at least one photosensitive drum provided in the main body to be able to hold a toner image; a transfer belt configured to transfer the toner image to the sheet-like medium while holding the sheet-like medium such that the sheet-like medium is able to contact the at least one photosensitive drum, wherein the transfer belt is provided in the main body to form a conveying surface which is a part of the conveying path and holds the sheet-like medium on a photosensitive drum side; a fixing unit configured to fix the toner image to the sheet-like medium, wherein the fixing unit is arranged at a position where the sheet-like medium is bent from the conveying surface on a downstream side along the conveying path with respect to the transfer belt in the main body; and an antistatic member configured to remove static electricity to suppress detachment discharge caused when the sheet-like medium is detached from the transfer belt, wherein the antistatic member is situated in the main body at a position on a downstream side of the at least one photosensitive drum and on an upstream side of the fixing unit along the conveying path. In this configuration, the at least one photosensitive drum is held on a photosensitive drum holding body configured to be detachably attachable to the main body. The antistatic member is provided for the photosensitive drum holding body on a downstream side with respect to a contact position between the at least one photosensitive drum and the sheet-like medium on the conveying surface and on the photosensitive drum side.

According to another aspect of the invention, there is provided an image forming apparatus configured to form an image on a sheet-like medium through electrophotography, comprising: a housing; a holding member having a photosensitive drum configured to hold a toner image, and an antistatic member configured to remove charges from the sheet-like member, wherein the holding member is configured to be detachably attachable to the housing; a belt unit having a belt, a drive roller configured to drive and rotate the belt, an idle roller configured to be rotated by rotation of the belt, wherein the belt is provided to extend between the drive roller and the idle roller, and wherein the belt unit is arranged in the housing and is configured to transfer the toner image held on the photosensitive drum to the sheet-like medium while conveying the sheet-like medium from the idle roller to the drive roller by sandwiching the sheet-like medium between the photosensitive drum and the belt; and a fixing unit configured to fix the toner image transferred to the sheet-like medium, wherein the fixing unit is provided in the housing at a position closer to the drive roller relative to the idle roller. In this configuration, the antistatic member is attached to the holding member such that the antistatic member is situated at a position between the photosensitive drum and the fixing unit in a state where the holding member is attached to the housing. The antistatic member is configured to remove charges from the sheet-like medium at the position between the photosensitive drum and the fixing unit.

BRIEF DESCRIPTION OF THE ACCOMPANYING DRAWINGS

DETAILED DESCRIPTION

Hereafter, embodiments according to the invention will be described with reference to the accompanying drawings.

First Embodiment

Figure 1:
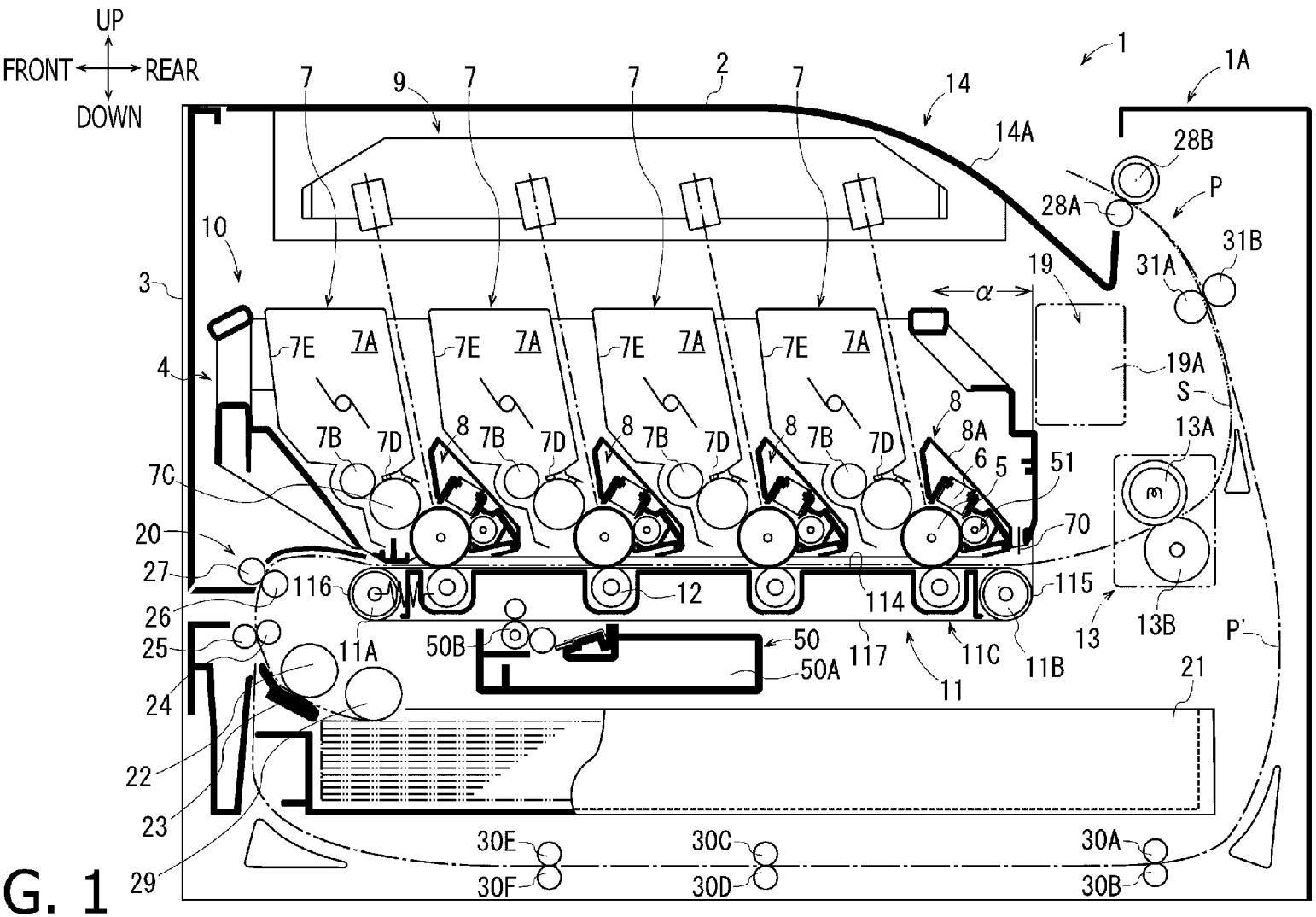
FIG. 1 is a cross section generally illustrating a printer according to a first embodiment.
Figure 2:
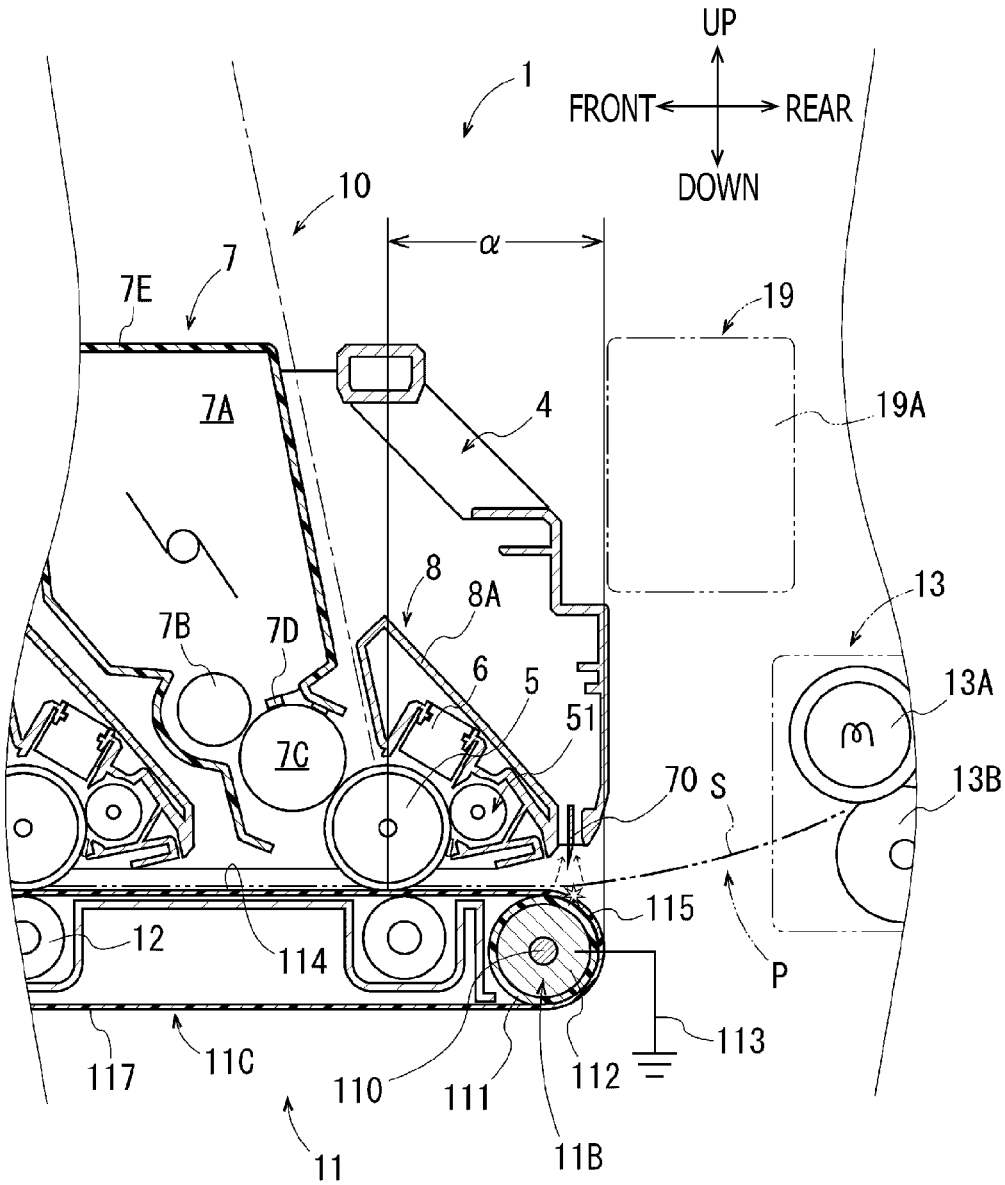
FIG. 2 is a partial enlarged cross section of the printer 1 according to the first embodiment.

As shown in FIG. 1, a printer 1 according to a first embodiment which is an example of an image forming apparatus according to the invention is a color laser printer which forms color images on both sides of a sheet-like medium S (e.g., a sheet of paper, an OHP sheet and etc.) through an electrophotographic process. In FIGS. 1 and 2, the front and rear direction and the up and down direction are represented by defining the left side on a paper surface as a front side and defining the right side on the paper surface as a rear side. Hereafter, components provided in the printer 1 are explained.

As shown in FIG. 1, the printer 1 includes a printer main body 1A serving as a device main body. The printer main body 1A includes a box-shaped housing 2 and a frame member (not shown) provided in the inside of the housing 2. In the housing 2, a paper supply unit 20, an image formation unit 10, a belt unit 11, an ejection unit 14 and a control unit 19 are installed.

On the front surface of the housing 2, a front cover 3 which is openable and closable with respect to the lower side serving as a swing center axis is provided. By opening the front cover 3, a drawer 4 which is described later can be inserted toward the rear side, and the drawer 4 which has been inserted into the housing 2 can be drawn toward the front side.

<Explanation of Paper Supply Unit>

The paper supply unit 20 is provided under the housing 2, and includes a paper supply cassette 29, a separation supply roller 22, a separation pad 23, conveying rollers 24 and 25 and registration rollers 26 and 27.

The paper supply cassette 21 has a box-shape whose upper side is opened, and accommodates the sheet-like medium S therein. The paper supply cassette 21 is attached to the printer main body 1A by being inserted into the housing 2, and can be withdrawn from the printer main body 1A through an inverse operation. The paper supply cassette 21 can be completely detached from the printer main body 1A in the withdrawn state.

The sheet-like medium accommodated in the paper supply cassette 21 is conveyed by a paper supply roller 29, and is sent out one-by-one by the separation roller 22 and the separation pad 23. Then, the sheet-like medium S which has been sent out makes a U-turn by the conveying rollers 24 and 25 and the registration rollers 26 and 27, and is conveyed to the image formation unit 10.

<Explanation of Image Formation Unit>

The image formation unit 10 includes four photosensitive drums 5, four development units 7, a belt unit 11, a belt cleaning unit 50, a fixing unit 13 and a scanner unit 9.

The four photosensitive drums 5 are arranged in the front and rear direction of the printer 1, and are held on the drawer 4 having a shape of a frame. The drawer 4 can be moved with respect to the printer main body 1A by inserting into or withdrawing from the housing 2 in the state where the front cover 3 is opened. The drawer 4 is detachable from the printer main body 1A. In the state where the drawer 4 is inserted into the housing 2, the drawer 4 is electrically connected to the printer main body 1A via contact points.

Each developer unit 7 includes a toner reservoir 7A, a supply roller 7B and a development roller 7C. The development unit 7 is located on an upper side of the photosensitive drum 5 in a slanting direction. The development units 7 are respective arranged upwardly in a slanting direction with respect to the photosensitive drums 5, and respectively correspond to the photosensitive drums 5 of four colors of black, yellow, magenta and cyan. A development frame 7E has a box-shape whose lower rear side is opened. The toner reservoir 7A is provided at an upper portion in the development frame 7E, and accommodates toner of a corresponding color. The supply roller 7B is provided in the lower portion of the development frame 7E. The development roller 7C is provided to be exposed through an opening of the development frame 7E, and faces the photosensitive drum 5. The toner in the toner reservoir 7A is supplied to the development roller 7C side by rotations of the supply roller 7B, and is held on a surface of the development roller 7C. Then, the toner held on the surface of the development roller 7C is adjusted to have a predetermined thickness by a layer thickness restriction blade 7D, and is supplied to the photosensitive drum 5.

Each development unit 7 is attached to the drawer 4 and is held on the drawer 4. Each development unit 7 can be detached from the drawer 4 by moving the development unit 7 upward when the drawer 4 is withdrawn from the housing 2. As a result, maintenance and replacement of the development unit 7 can be performed.

As shown in FIG. 2, as in the case of the photosensitive drum 5, each drum unit 8 is held on the drawer 4. Each drum unit 8 includes a frame member 8A, a charger 6 and a drum cleaning unit 51. The charger 6 and the drum cleaning unit 51 are arranged in the frame member 8A. The charger 6 is provided to face the photosensitive drum 5, and charges positively the photosensitive drum 5.

Figure 3:
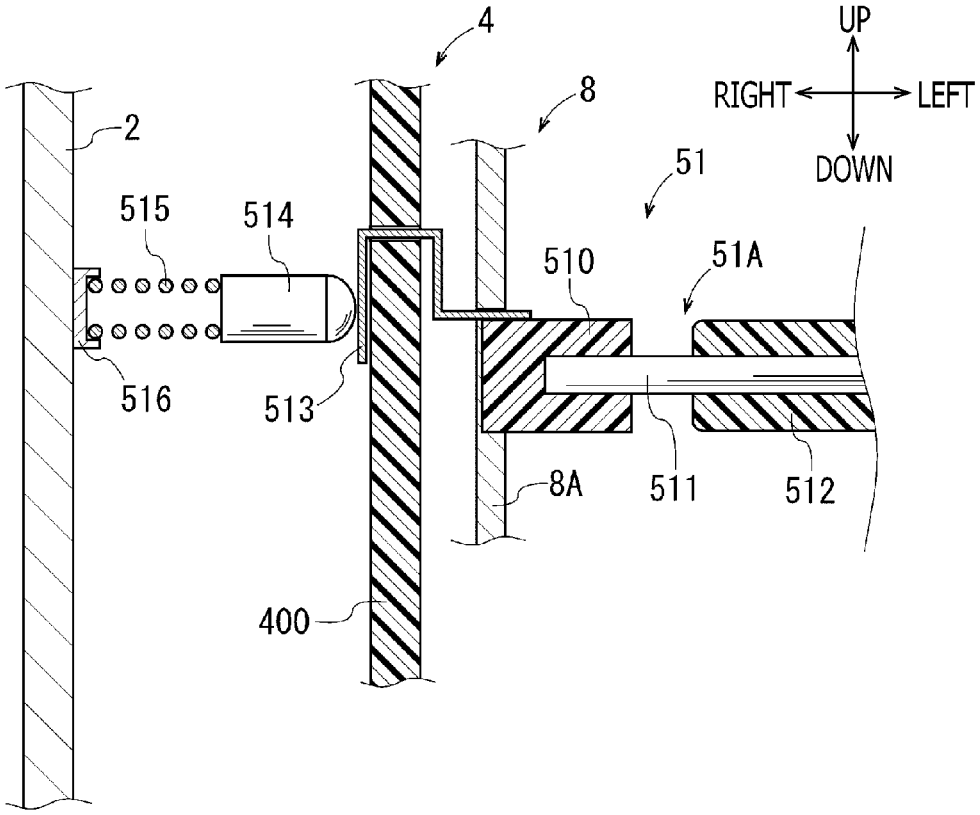
FIG. 3 is a cross section illustrating a drum cleaning unit of the printer according to the first embodiment.

As shown in FIG. 3, the drum cleaning unit 51 includes a first conductive bearing 510, and a cleaning roller 51A which is integrally formed of a metal roller shaft 511 and an elastic conductive layer 512. The first conductive bearing 510 is made of conductive resin. The first conductive bearing 510 is supported by the frame member 8A. An end of the roller shaft 511 is rotatably supported by the first conductive bearing 510. The first conductive bearing 510 is electrically connected to a contact point 514 via an electrode 513. The electrode 513 is held by a resin frame 400 constituting the drawer 4. The contact point 514 is attached to the housing 2 in a state where the contact point 514 is pressed in the left and right direction of the printer 1 by a spring 515, and is electrically connected to a power supply (not shown) provided in the housing 2. The spring 515 is fixed to a spring seat 516 provided in the housing 2.

As described above, by electrically connecting the first conductive bearing 510 with the contact point 514, the charge of reverse polarity with respect to the toner is applied to the drum cleaning unit 51 when an image formation operation which is described later is executed. Specifically, by electrifying from the contact point 514 in order of the electrode 514, the first conductive bearing 510 and the roller shaft 511, the cleaning roller 51A is charged in reverse polarity with respect to the toner. As a result, the cleaning roller 51A in the drum cleaning unit 51 electrically attracts and temporarily holds the toner which remains on the surface of the photosensitive drum 5 in a small amount without being transferred to the sheet-like medium S.

As shown in FIG. 1, the belt unit 11 is arranged between the paper supply cassette 21 and the drawer 4. The belt unit 11 includes a first roller 11A, a second roller 11B, a transfer belt 11*c* and four transfer rollers 12. In the belt unit 11, the first roller 11A is arranged at a position on the most upstream side (the front side) along a conveying path P. In the belt unit 11, the second roller 11B is arranged on the most downstream side (the rear side) along the conveying path P. Each transfer roller 12 is provided in the belt unit 11. Between the first roller 11A and the second roller 11B, the transfer rollers 12 are arranged to face the photosensitive drums 5, respectively. A detailed configuration of the belt unit 11 is explained later.

The belt cleaning unit 50 is arranged under the belt unit 11. The belt cleaning unit 50 includes a toner collection chamber 50A and a bias roller 50B. The bias roller 50B is connected to a high-voltage unit of the printer 1 via a contact point (not shown).

The fixing unit 13 is arranged, on the downstream side of the transfer belt 11C along the conveying path P, at a position where the sheet-like medium S being carried in a horizontal state on a conveying surface 114 of the transfer belt 11C which is a part of the conveying path P is turned upward from the transfer belt 11C. That is, in the housing 2, the fixing unit 13 is arranged on the photosensitive drum 5 side which is the upper side with respect to the transfer belt 11C.

The fixing unit 13 includes a heat roller 13A and a press roller 13B. The heat roller 13A rotates in synchronization with the conveying belt 11C, and provides a conveying force for the sheet-like medium S while heating the toner transferred to the sheet-like medium S. On the other hand, the press roller 13B is driven and rotated by the heat roller 13A while pressing the sheet-like medium S toward the heat roller 13A side. As a result, the fixing unit 13 heats and fuses the toner transferred to the sheet-like medium S so as to fix the toner to the sheet-like medium S, and conveys the sheet-like medium S to the downstream side along the conveying path P. It should be noted that the conveying path P is turned upward in a shape of a letter "U" on the downstream side with respect to the fixing unit 13.

The scanner unit 9 is located at an upper portion in the housing 2, and includes a laser source, a polygonal mirror, an fθ lens and a reflector. In the scanner unit 9, the surfaces of the photosensitive drums 5 are irradiated with laser beams emitted from the laser source via the polygonal mirror, the fθ lens and the reflector, and thereby electrostatic latent images respectively corresponding to four colors of black, yellow, magenta and cyan are formed.

<Explanation of Ejection Unit>

The ejection unit 14 includes guide rollers 31A and 31B, ejection rollers 28A and 28B, and an ejection tray 14A. The ejection tray 14A is provided on the upper side of the housing 2, and the sheet-like medium S ejected by the ejection rollers 28A and 28B is stacked thereon.

<Explanation of Control Unit>

The control unit 19 includes an electric motor 19A. The electric motor 19A has a known configuration, and explanation thereof is omitted. The control unit 19 controls operations of the paper supply unit 20, the image formation unit 10, the belt unit 11 and the ejection unit 14 by driving the electric motor 19A.

<Detailed Explanation of Belt Unit>

As shown in FIG. 2, the second roller 11B is supported by a rotation shaft 110 which is provided in the belt unit 11 to extend in the width direction of the housing 2. The second roller 11B is a metal roller having an insulation layer 111 on a surface thereof, i.e., an outer circumferential surface. In addition, a metal part 112 of the second roller 112 is grounded on the outside of the printer 1 via a wire 113. The metal part 112 may be grounded via a component, such as a diode. The first roller 11A shown in FIG. 1 has the same configuration.

The transfer belt 11C is a film-like member having conductivity. As shown in FIG. 1, the transfer belt 11C is provided to extend between the first roller 11A and the second roller 11B. As described above, the transfer belt 11C is provided to extend between the first roller 11A and the second roller 11B and is supported by the transfer rollers 12 while contacting the transfer rollers 12, and therefore the transfer belt 12C forms a conveying surface 114, a first turning surface 115, a second turning surface 116 and a returning surface 117

The conveying surface 114 of the transfer belt 11C is situated on the photosensitive drum 5 side, and forms a part extending in a horizontal direction between the first roller 11A and the second roller 11B. The conveying surface 114 forms a part of the conveying path P. The transfer belt 11C is charged by applying a transfer voltage to the transfer rollers 12, so that the sheet-like medium S is adhered to the conveying surface 114 through an electrostatic force. As a result, the transfer belt 11C conveys horizontally the sheet-like medium S from the upstream side to the downstream side along the conveying path P, while holding the sheet-like medium S on the conveying surface 114 such that the sheet-like medium S is able to contact the photosensitive drums 5. At this time, the transfer rollers 12 transfer the toner images held on the photosensitive drums 5 to the sheet-like medium S.

As shown in FIG. 2, the first turning surface 115 continues to the conveying surface 114 on the downstream side and is formed at a position where the first returning surface 115 is turned toward the first roller 11A by the second roller 11B. That is, the first turning surface 115 is formed along the outer circumferential surface (the insulation layer 111) of the second roller 11B which is on the downstream side on the conveying path P.

As shown in FIG. 1, the second turning surface 116 continues to the conveying surface 114 on the upstream side, and is formed at a position where the second turning surface 116 is tuned toward the second roller 11B by the first roller 11A. The retuning surface 117 continues to the first retuning surface 115 and the second returning surface 116, and is formed at a position facing the conveying surface 114.

<Explanation of Antistatic Needle>

Figure 4:
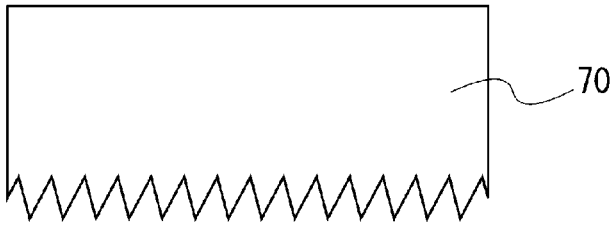
FIG. 4 is a front view of an antistatic needle.

As shown in FIG. 2, an antistatic needle 70 is attached to the drawer 4. As shown in FIG. 4, the antistatic needle 70 is formed such that a plurality of acute angle parts are formed on an edge of a metal plate. As shown in FIG. 2, the antistatic needle 70 is fixed to a rear part of the drawer 4, i.e., a downstream portion of the drawer 4 along the conveying path P. More specifically, the antistatic needle 70 is located on the downstream side with respect to a position where the photosensitive drum 5 located on the most downstream side of the four photosensitive drums 5 contacts the sheet-like medium S on the conveying path P, and within a range (i.e., a range indicated by a reference symbol α in FIG. 2) including a part of the first returning surface 115 on the photosensitive drum 5 side.

Between the antistatic needle 70 and the photosensitive drum 5, a part of the drum unit 8 is situated. That is, the antistatic needle 70 is located on the downstream side with respect to the frame member 8A forming the drum unit 8, and is situated at a position blocked by the frame member 8A with respect to the photosensitive drum 5.

Figure 5:
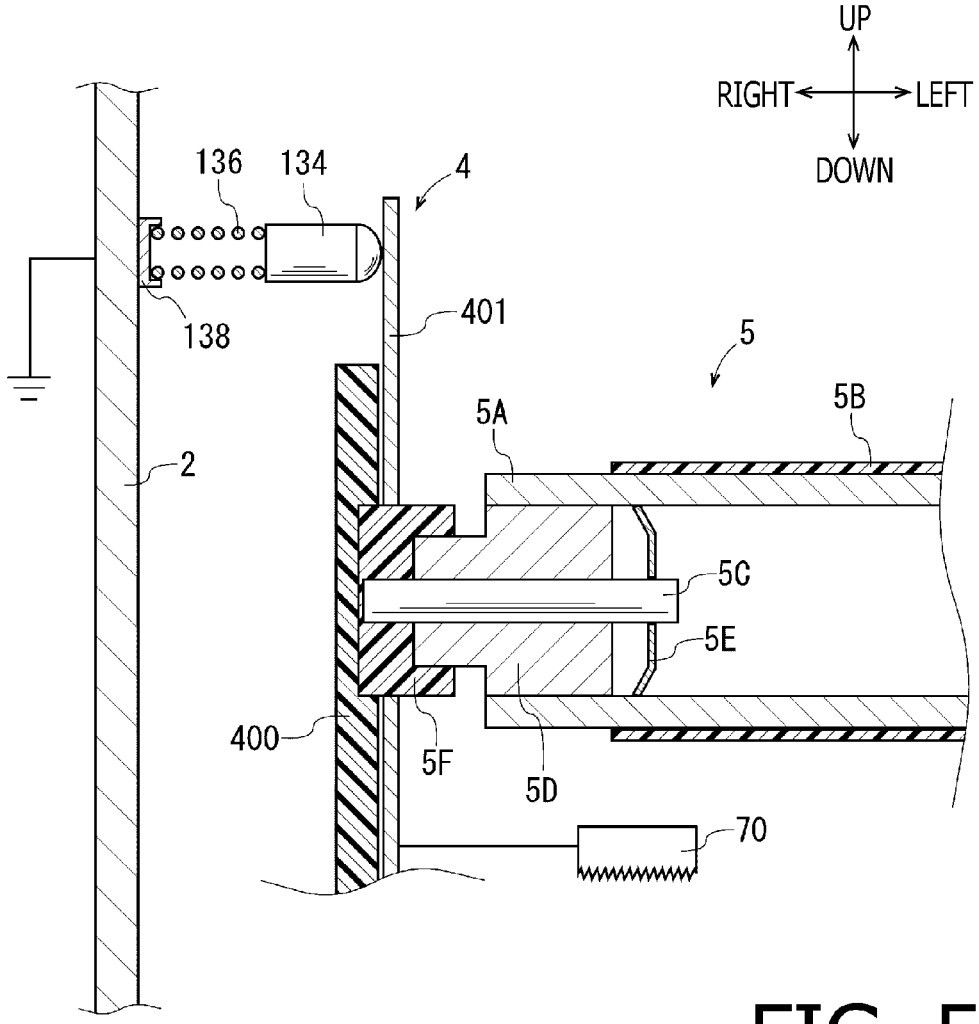
FIG. 5 is a cross section illustrating earth connection of a photosensitive drum and the antistatic needle of the printer according to the first embodiment.

As shown in FIG. 5, the antistatic needle 70 and the photosensitive drum 5 are grounded on the outside of the printer 1. More specifically, the photosensitive drum 5 includes a drum element tube 5A, a surface layer 5B, a rotation shaft 5C, a holding member 5D and a spring 5E. The surface layer 5B is provided on the outer circumferential surface of the drum element tube 5A. The holding member 5D is attached to the drum element tube 5A. The rotation axis 5C is inserted into the drum element tube 5A in a state of being fixed to the holding member 5D. The rotation shaft 5C inserted into the drum element tube 5A can be electrically connected to the drum element tube 5A via the spring 5E.

A part of the rotation shaft 5C and the holding member 5D is supported by a second conductive bearing 5F. The second conductive bearing 5F is fixed to the resin frame 400 and a metal frame 401. The metal frame 401 constitutes the drawer 4, together with the resign frame 400. Each of the second conductive bearing 5F and the metal frame 401 serves as the earth. The antistatic needle 70 is electrically connected to the metal frame 401. The antistatic needle 70 may be electrically connected to the second conductive bearing 5F.

An earth contact point 134 is connected to the housing 2 via a spring 136 in a state where the earth contact point 134 is pressed in the left and right direction. The spring 136 is connected to a spring seat 138 provided on the housing 2. With this configuration, by inserting the drawer 4 into the housing 2, the metal frame 401 contacts the earth contact point 134. As a result, the photosensitive drum 5 and the antistatic needle 70 are grounded via the metal frame 401 and the second conductive bearing 5F. Specifically, regarding the photosensitive drum 5, the drum element tube 5A is grounded via the spring 5E, the rotation shaft 5C, the second conductive bearing 5F, the metal frame 401 and the earth contact point 134. The antistatic needle 70 is grounded via the metal frame 401 and the earth contact point 134.

<Explanation of Conveying Path>

As indicated by a double-chain line in FIG. 1, the conveying path P having a shape of a letter "S" is formed from the paper supply unit 20 located in the lower portion to reach the ejection unit 14 via the image formation unit 10. The sheet-like medium S is conveyed from the paper supply unit 20 to the ejection unit 14 along the conveying path P. More specifically, after making a U-turn on the front side in the front portion of the housing 2, the sheet-like medium S being conveyed from the paper supply cassette 21 is conveyed, toward the image formation unit 10, from the front side to the rear side. Then, the sheet-like medium S makes a U-turn in the rear portion of the housing 2, and is conveyed, toward the ejection tray 14A, from the rear side to the front side. It should be noted that in FIG. 1 the shape of the conveying path P is represented as the shape of the sheet-like medium S being carried along the conveying path P. The same applies to FIGS. 2 and 6.

In this embodiment, the upstream side means the front side of the housing 1, and the downstream side means the rear side of the housing 2.

In the housing 2, a re-conveying path P' indicated by a chain line in FIG. 1 is formed. The re-conveying path P' is formed to extend downward toward the paper supply cassette 21, in the lower portion of the housing 2. Through the re-carrying path P', the sheet-like medium S having an image formed on one side thereof is conveyed so that the sheet-like medium S is directed to the conveying path P in a state where an image can be formed on the other side of the sheet-like medium S.

Specifically, in the re-conveying path P', re-conveying rollers 30A to 30F are arranged. By driving the re-conveying rollers 30A to 30F, the sheet-like medium S having an image formed on one side thereof is drawn to the re-conveying path P' so that the sheet-like medium S is re-conveyed to the conveying rollers 24 and 25 and the registration rollers 26 and 27. As a result, the paper supply unit 20 serves as a re-conveying unit.

<General Explanation about Image Formation Operation>

In the printer 1 having the above described configuration, the control unit 19 controls the paper supply unit 20, the image formation unit 10, the belt unit 11 and the ejection unit 14, and thereby the image formation operation is performed as described below.

When the control unit 19 starts controlling, the paper supply unit 20, the image formation unit 10, the belt unit 11 and the ejection unit 14 are activated. As a result, the sheet-like medium S in the paper supply cassette 21 is conveyed to the image formation unit 10, and components including the scanner unit 9 and the development unit 7 execute the above described operations. Consequently, after the surface (the surface layer 5B) of the rotation photosensitive drum 5 is charged by the charger 6 uniformly and positively, the photosensitive drum 5 is exposed by the laser beam emitted from the scanner unit 9, and an electrostatic latent image corresponding to image formation data is formed on the surface of the photosensitive drum 5 by reversal development.

The toner held on the surface of the photosensitive drum 5 is transferred to the sheet-like medium S on the conveying surface 114 through the transfer voltage applied to the transfer roller 12. Thus, the toner of the respective colors is sequentially transferred to be overlapped with each other, and the sheet-like medium S is conveyed to the fixing unit 13. At this time, the sheet-like medium S on the conveying surface 114 is bent toward the upper side of the transfer belt 11C.

The sheet-like medium S conveyed to the fixing unit 13 is pressed and heated by the heat roller 13A and the press roller 13B. As a result, a toner image is fixed on the sheet-like medium S. Thereafter, the sheet-like medium S on which an image has been formed is ejected to the ejection tray 14A, and thus the image formation operation is finished.

When the image formation is performed on both sides of the sheet-like medium S, the re-conveying rollers 30A to 30F are activated as described above. As a result, the sheet-like medium S for which the image formation has been finished for one side is directed to the re-conveying path P'. Then, in the state where the image formation can be performed for the other side of the sheet-like medium S, the sheet-like medium S is directed to the upstream side of the conveying path P, i.e., to the conveying rollers 24 and 25 and the registration rollers 26 and 27.

The toner adhered to the conveying surface 114 when the toner image is transferred to the sheet-like medium S on the conveying surface 114 is collected in the belt cleaning unit 50. Specifically, the control unit 19 charges the bias roller 50B to have a reverse polarity with respect to the toner. As a result, the bias roller 50B absorbs the toner adhered to the returning surface 117. The toner absorbed by the bias roller 50B is collected in the toner collection chamber 50A. Thus, cleaning of the transfer belt 11C is completed.

As described above, in the printer 1, when the sheet-like medium S to which the toner image has been transferred is conveyed, the sheet-like medium S is brought to a bended state. Therefore, the sheet-like medium S which is absorbed on the conveying surface 114 of the transfer belt 11C through an electrostatic force by the transfer roller 12 is detached from the transfer belt 11C within the rage including the conveying surface 114 and a part of the turning surface 115 on the photosensitive drum 5 side, after the sheet-like medium S has contacted the most downstream photosensitive drum 5. Specifically, within the range $\alpha$ shown in FIG. 2, the sheet-like medium S is detached from the transfer belt 11C. In this case, detachment discharge is caused between the charged sheet-like medium S and the transfer belt 11C. By the effect of such detachment discharge, the toner transferred to the sheet-like medium S is scattered, and causes disturbance in the image formed on the sheet-like medium S.

In particular, when the image formation is performed for the both sides of the sheet-like medium S, the sheet-like medium S is in a dry state and in a curled state due to the image formation on one side of the sheet-like medium by the fixing unit 13. Therefore, when the image formation is performed for the other side of the sheet-like medium S, the above described detachment discharge becomes easy to occur, and thereby the toner provided on the other side of the sheet-like medium becomes easy to scatter.

In this regard, in the printer 1, the antistatic needle 70 is located within the range α where the above described detachment discharge would occur in the state where the antistatic needle 70 is attached to the rear portion of the drawer 4. Therefore, the printer 1 is able to effectively suppress scattering of the toner.

In the printer 1, the antistatic needle 70 is provided for the drawer 4 which is detachably attachable to the housing 2. Therefore, in the printer 1, when the drawer 4 is replaced by being detached from the housing 2, i.e., when the photosensitive drum 5 is replaced, the antistatic needle 70 can also be replaced simultaneously. It is also possible to perform replacement and cleaning only for the antistatic needle 70 without depending on replacement for the photosensitive drum 5. Consequently, in the printer 1, the toner does not continue to adhere to the antistatic needle 70 and thereby it becomes possible to sufficiently suppress the detachment discharge even if the printer 1 is used for a long period of time.

Therefore, the printer 1 according to the first embodiment is able to form a high quality image on the sheet-like medium S even if the printer 1 is used for a long period of time.

In particular, in the printer 1, the antistatic needle 70 which is a self-discharge type antistatic unit is employed as an antistatic member. Therefore, the antistatic member can be configured with a simple component. In addition, the self-discharge type antistatic unit like the antistatic needle 70 does not require a high voltage bias. Furthermore, in the self-discharge type antistatic unit, the degree of electricity-removal automatically changes depending on the charged state of the sheet-like medium S which is a target for the electricity-removal. Therefore, in the printer 1, failure due to the excessive electricity-removal by the antistatic needle 70 is hard to occur. In the printer 1, the insulation layer 111 is provided on the surface of the second roller 11B, and the metal part 112 of the second roller 11B is grounded. Therefore, the sheet-like medium S is hard to be affected by the charge of the second roller 11B.

Furthermore, in the printer 1, the drawer 4 is electrically connected to the printer main body 1A and the metal frame 401 contacts the earth contact point 134 as shown in FIG. 5, by inserting the drawer 4 into the housing 2. The antistatic needle 70 is attached to the drawer 4, and the antistatic needle 70 is grounded by being electrically connected to the metal frame 401. Therefore, in the printer 1, it is not required to provide a dedicated contact point for grounding the antistatic needle 70. Consequently, in the printer 1, attachment/detachment of the drawer 4, i.e., replacement of the antistatic needle 70 can be conducted easily.

Second Embodiment

Figure 6:
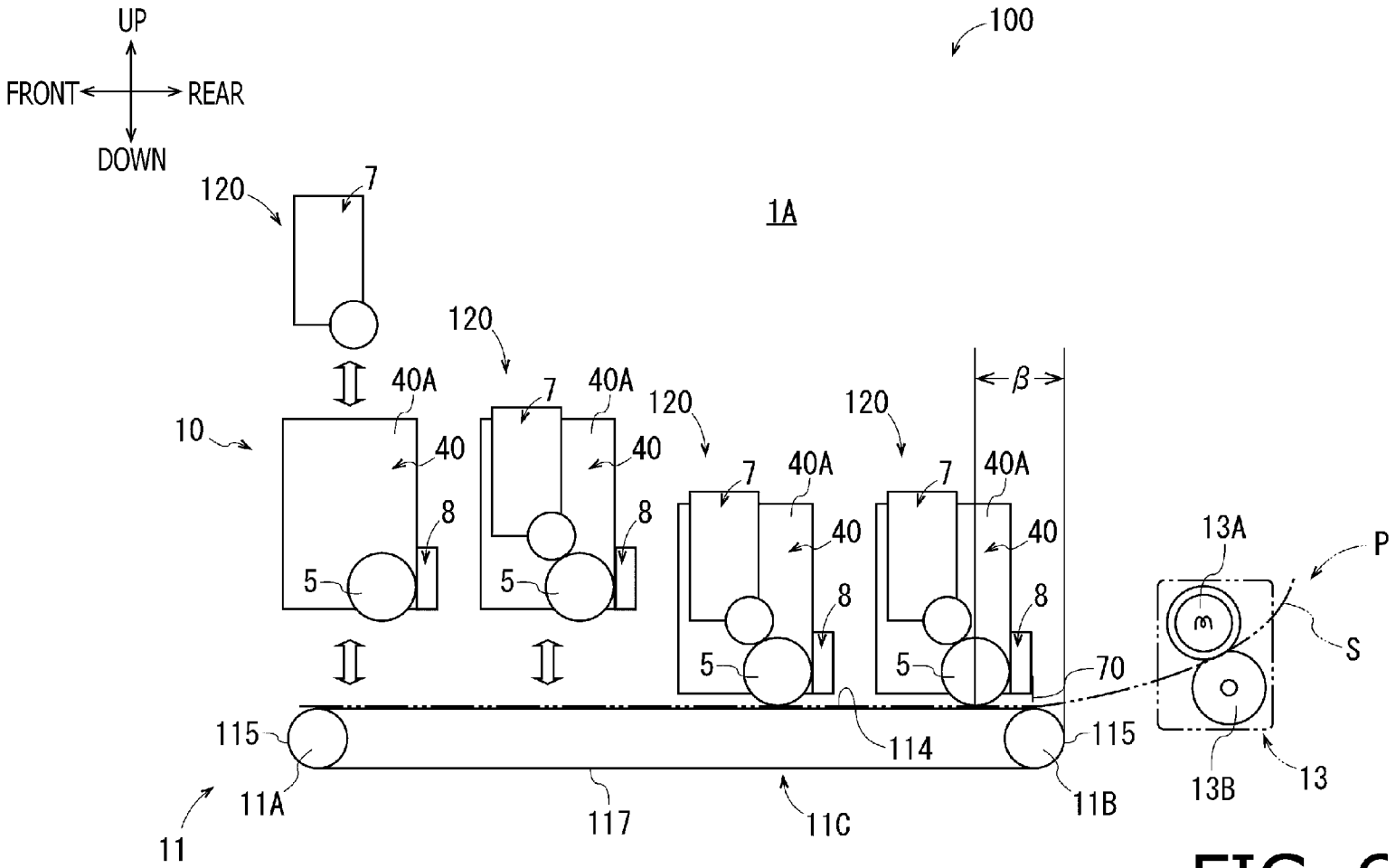
FIG. 6 is a partial block diagram of a printer according to a second embodiment.

FIG. 6 shows a printer 100 according to a second embodiment. In the printer 1 according to the first embodiment, the drawer 4 holding the photosensitive drums 5 is provided in the printer main body 1A. By contrast, in the printer 100 according to the second embodiment, four drum cartridges 40 are detachably attachable to the printer main body 1A.

Each drum cartridge 40 includes a case 40A and a drum unit 8 attached to the case 40A. Furthermore, in the drum cartridge 40, the photosensitive drum 5 is held. The development unit 7 is attachable to the case 40A of the drum cartridge 40. Although, in FIG. 6, the photosensitive drum 5, the development unit 7 and the drum unit 8 are illustrated in a simplified manner, they have the same configurations as the photosensitive drum 5, the development unit 7 and the drum unit 8 in the first embodiment.

By attaching the development unit 7 to the drum cartridge 40, the drum cartridge 40 and the development unit 7 integrally function as a process cartridge 120. Each process cartridge 120 is detachably attachable to the printer main body 1A. Specifically, the process cartridge 120 is detached upwardly from the printer main body 1A (the housing 2 shown in FIG. 1), and thereafter the development unit 7 can be separated from the drum cartridge 40. At this time, if necessary, the drum cartridge 40 or the development unit 7 may be replaced with new one, and may be attached to the printer main body 1A again as the process cartridge 120. The drum unit 40 (the process cartridge 120) is electrically connected to the printer main body 1A via contact points (not shown) in the state of being connected to the printer main body 1A.

The antistatic needle 70 is provided for the most downstream one of the drum cartridges 40 along the conveying path P. The antistatic needle 70 is attached to the drum cartridge 40 in the same attachment manner as that of the drawer 4 and the antistatic needle 70 in the first embodiment. The antistatic needle 70 is connected to an earth member (the metal frame 401 or the second conductive bearing 5F in FIG. 5) provided in the drum cartridge 40, and thereby the antistatic needle 70 is grounded.

Since the antistatic needle 70 is fixed to the most downstream one of the drum cartridges 40, the antistatic needle 70 is situated within a range (a range indicated by a reference symbol β in FIG. 6) which is on the downstream side along the conveying path P with respect to the contact point between the photosensitive drum 5 of the most downstream drum cartridge 40 and the sheet-like medium S on the conveying surface 114 and which includes a part of the first turning surface 115 on the photosensitive drum 5 side. The other configurations in the printer 100 which are omitted in FIG. 6 are the same as those of the printer 1 according to the first embodiment.

As in the case of the first embodiment, the antistatic needle 70 suitably suppress the detachment discharge in the printer 100, and thereby scattering of the toner on the sheet-like medium S can be effectively suppressed. When the drum cartridge 40 is replaced by detaching the drum cartridge 40 from the printer main body 1A, the antistatic needle 70 can also be replaced simultaneously. In addition, replacement and cleaning only for the antistatic needle 70 can be conducted. Therefore, in the printer 100, the toner does not continue to adhere to the antistatic needle 70, and therefore it is possible to sufficiently suppress the detachment discharge for a long period of time. The other advantages provided by the first embodiment can also be achieved by the printer 100.

Although the present invention has been described with reference to the first and second embodiments thereof, the present invention is not limited to the above described embodiments and variations can be provided within the scope of the invention.

Figure 7:
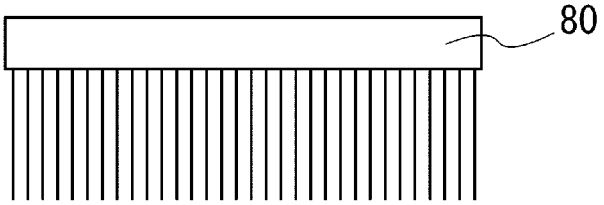
FIG. 7 is a front view of an antistatic brush.

For example, an antistatic brush 80 shown in FIG. 7 may be employed in place of the antistatic needle 70. The antistatic brush 80 is also a self-discharge type antistatic unit. Therefore, as in the case of the antistatic needle 70, the antistatic member can be configured with a simple component, and a high voltage bias is not required for the antistatic brush 80.

Figure 8:
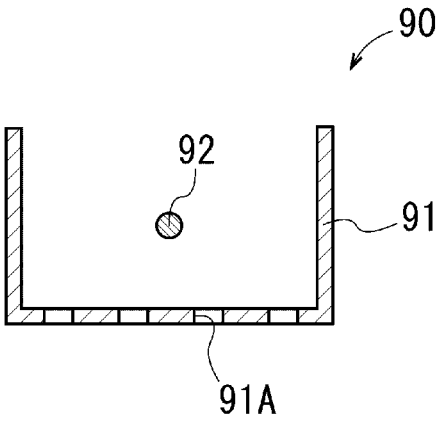
FIG. 8 is a cross section illustrating an antistatic unit.

It is also possible to employ an antistatic unit 90 shown in FIG. 8 as a antistatic member. The antistatic unit 90 includes a housing 91 having a plurality of openings 91A formed therein, and a discharge member 92 arranged in the housing 91. As in the case of the antistatic needle 70, the antistatic unit 90 is able to effectively suppress scattering of the toner due to the detachment discharge.

The antistatic needle 70 may be electrically connected to the first conductive bearing 510 in the drum cleaning unit 51, or may be directly and electrically connected to the bias roller 50B. This also applies to the antistatic brush 80.

The antistatic needle 70 is provided within the range a in the first embodiment, and is provided within the range β in the second embodiment. However, the present invention is not limited to such examples. The antistatic needle 70 may be provided between the fixing unit 13 and the contact position of the photosensitive drum 50 and the conveying surface 114.

In the first and second embodiments, the printers 1 and 100 each of which has a plurality of photosensitive drums 5 and supports color printing are described. However, the present invention is not limited to such examples. For example, the present invention may be applied to a monochrome printer which has a single photosensitive drum 5.

In the first and second embodiments, the printers 1 and 100 in which the belt unit 11 is arranged in the horizontal direction are described. However, the present invention is not limited to such examples. For example, the present invention may be applied to a printer in which the belt unit 11 is arranged in the vertical direction. For example, in place of arranging the belt unit 11 in the horizontal direction, the belt unit 11 may be arranged to be inclined to have a certain angle with respect to the horizontal direction. By configuring the printer such that the sheet-like medium S is bent, from the conveying surface 114, on the downstream side along the conveying path P with respect to the transfer belt 11C, the advantages of the present invention can be obtained.

What is claimed is:

1. An image forming apparatus, comprising:

a main body including a conveying path extending in a conveying direction where a sheet-like medium is conveyed;

a plurality of photosensitive drums provided in the main body and configured to hold a toner image;

a photosensitive drum holding body configured to hold the plurality of photosensitive drums and configured to be detachably attachable to the main body;

a transfer belt configured to transfer the toner image to the sheet-like medium while holding the sheet-like medium such that the sheet-like medium is able to contact the plurality of photosensitive drums, wherein the transfer belt is provided in the main body and forms a conveying surface which is a part of the conveying path and which holds the sheet-like medium on a photosensitive drum side of the transfer belt;

a fixing unit configured to fix the toner image to the sheet-like medium, wherein the fixing unit is arranged on the photosensitive drum side of the transfer belt at a position such that the sheet-like medium bends from the conveying surface towards the fixing unit on a downstream side of the transfer belt along the conveying path; and an antistatic member configured to remove static electricity to suppress detachment discharge caused when the sheet-like medium is detached from the transfer belt, wherein the antistatic member is positioned on a downstream side of the plurality of photosensitive drums and on an upstream side of the fixing unit along the conveying path, wherein:

the photosensitive drum holding body comprises a frame member; and the antistatic member is removably attached directly to the photosensitive drum holding body on a downstream side with respect to a contact position between the sheet-like medium and a downstream-most photosensitive drum of the plurality of photosensitive drums such that the antistatic member is configured to be detachably attachable to the main body along with the photosensitive drum holding body, the antistatic member being blocked by the frame member with respect to the plurality of photosensitive drums, and the antistatic member is configured to be removed from the photosensitive drum holding body when the photosensitive drum holding body is detached from the main body.

2. The image forming apparatus according to claim 1, wherein:

the transfer belt extends between a first roller arranged on an upstream side along the conveying path and a second roller arranged on a downstream side along the conveying path, so as to form the conveying surface and a turning surface, wherein the turning surface is turned by the second roller toward the first roller; and the antistatic member is provided on the photosensitive drum side of the transfer belt within a range including a part of the conveying surface and a part of the turning surface.

3. The image forming apparatus according to claim 2, wherein:

the antistatic member is a self-discharge type antistatic unit; and the second roller is a metal roller having an insulation layer on a surface of the second roller, and a metal part of the second roller is grounded.

4. The image forming apparatus according to claim 3, wherein:

the plurality of photosensitive drums are electrically connected to the main body via an earth member provided in the photosensitive drum holding body;

a plurality of drum cleaning units configured to collect toner remaining on the plurality of photosensitive drums, respectively, are provided in the photosensitive drum holding body;

a plurality of bias members electrically connected to the main body are provided in the plurality of drum cleaning units, respectively, wherein a reverse polarity voltage with respect to a polarity voltage of the toner is applied to each of the plurality bias members; and the self-discharge type antistatic unit is electrically connected to one of the earth member and the plurality of bias members.

5. The image forming apparatus according to claim 1, further comprising a re-conveying mechanism configured to re-convey, to the transfer belt, the sheet-like medium having an image formed on one side of the sheet-like medium so that an image is formed on the other side of the sheet-like medium.

6. The image forming apparatus according to claim 1, wherein a drum cleaning unit configured to collect toner remaining on the downstream-most photosensitive drum is provided in the photosensitive drum holding body, the drum cleaning unit being arranged on a downstream side, in the conveying direction, of the downstream-most photosensitive drum, and wherein the antistatic member is arranged on an opposite side, in the conveying direction, of the downstream-most photosensitive drum with respect to the drum cleaning unit.

7. The image forming apparatus according to claim 1, wherein the main body comprises a front cover, the front cover being disposed at an opposite side of the antistatic member with respect to the frame member, the front cover being configured to open and close an opening of the main body, and wherein the photosensitive drum holding body is detached from the main body by being drawn through the opening in a state where the opening is opened.

8. The image forming apparatus according to claim 1, further comprising:

a contact point attached to the main body and grounded; and a metal frame constituting the photosensitive drum holding body, wherein:

the antistatic member is electrically connected to the metal frame, and when the photosensitive drum holding body is attached to the main body, the contact point and the metal frame are electrically connected with each other, and the antistatic member is grounded via the contact point and the metal frame.

9. An image forming apparatus configured to form an image on a sheet-like medium through electrophotography, comprising:

a housing including a conveying path extending in a conveying direction where the sheet-like medium is conveyed;

a holding member having a plurality of photosensitive drums configured to hold a toner image, an antistatic member configured to remove charges from the sheet-like medium, and a frame member, wherein the holding member is configured to be detachably attachable to the housing;

a belt unit having a belt, a drive roller configured to drive and rotate the belt, and an idle roller configured to be rotated by rotation of the belt, wherein the belt extends between the drive roller and the idle roller, and wherein the belt unit is arranged in the housing and is configured to transfer the toner image held on the plurality of photosensitive drums to the sheet-like medium while conveying the sheet-like medium from the idle roller to the drive roller by sandwiching the sheet-like medium between the plurality of photosensitive drums and the belt; and a fixing unit configured to fix the toner image transferred to the sheet-like medium, wherein the fixing unit is provided in the housing at a position closer to the drive roller than to the idle roller, wherein:

the antistatic member is removably attached directly to the holding member such that the antistatic member is situated at a position between a downstream-most photosensitive drum of the plurality of photosensitive drums and the fixing unit in a state where the holding member is attached to the housing such that the antistatic member is configured to be detachably attachable to the housing along with the holding member, the antistatic member being blocked by the frame member with respect to the plurality of photosensitive drums, the antistatic member is configured to be removed from the holding member when the holding member is detached from the housing; and the antistatic member is configured to remove charges from the sheet-like medium at the position between the downstream-most photosensitive drum and the fixing unit.

10. The image forming apparatus according to claim 9, wherein:

the antistatic member is a self-discharge type antistatic unit; and the drive roller is a metal roller having an insulation layer on a surface of the drive roller, and a metal part of the drive roller is grounded.

11. The image forming apparatus according to claim 10, wherein:

the plurality of photosensitive drums are electrically connected to the housing via an earth member provided in the holding member; and the self-discharge type antistatic unit is electrically connected to the earth member.

12. The image forming apparatus according to claim 9, wherein a main body of the image forming apparatus comprises a front cover, the front cover being disposed at an opposite side of the antistatic member with respect to the frame member, the front cover being configured to open and close an opening of the main body, and wherein the holding member is detached from the main body by being drawn through the opening in a state where the opening is opened.

13. The image forming apparatus according to claim 9, further comprising:

a contact point attached to a main body of the image forming apparatus and grounded; and a metal frame constituting the holding member, wherein:

the antistatic member is electrically connected to the metal frame, and when the holding member is attached to the main body, the contact point and the metal frame are electrically connected with each other, and the antistatic member is grounded via the contact point and the metal frame.

14. An image forming apparatus, comprising:

a main body including a conveying path extending in a conveying direction where a sheet-like medium is conveyed;

at least one photosensitive drum provided in the main body and configured to hold a toner image;

a photosensitive drum holding body configured to hold the at least one photosensitive drum and configured to be detachably attachable to the main body;

a transfer belt configured to transfer the toner image to the sheet-like medium while holding the sheet-like medium such that the sheet-like medium is able to contact the at least one photosensitive drum, wherein the transfer belt is provided in the main body and forms a conveying surface which is a part of the conveying path and which holds the sheet-like medium on a photosensitive drum side of the transfer belt;

a fixing unit configured to fix the toner image to the sheet-like medium, wherein the fixing unit is arranged at a position such that the sheet-like medium bends from the conveying surface towards the fixing unit on a downstream side of the transfer belt along the conveying path; and an antistatic member configured to remove static electricity to suppress detachment discharge caused when the sheet-like medium is detached from the transfer belt, wherein the antistatic member is positioned on a downstream side of the at least one photosensitive drum and on an upstream side of the fixing unit along the conveying path, wherein:

the transfer belt extends between a first roller arranged on an upstream side along the conveying path and a second roller arranged on a downstream side along the conveying path, so as to form the conveying surface and a turning surface, wherein the turning surface is turned by the second roller toward the first roller;

the photosensitive drum holding body comprises a frame member;

the antistatic member is removably provided in the photosensitive drum holding body on a downstream side with respect to a contact position between the at least one photosensitive drum and the sheet-like medium on the conveying surface such that the antistatic member is configured to be detachably attachable to the main body along with the photosensitive drum holding body, the antistatic member being blocked by the frame member with respect to the at least one photosensitive drum, and the antistatic member is configured to be removed from the photosensitive drum holding bod when the photosensitive drum holding bod is detached from the main body;

the antistatic member is provided on the photosensitive drum side of the transfer belt within a range including a part of the conveying surface and a part of the turning surface; and the antistatic member is arranged closer to the second roller than to the at least one photosensitive drum.

15. The image forming apparatus according to claim 14, wherein:

the antistatic member is arranged at a position corresponding to the turning surface.

16. The image forming apparatus according to claim 14, wherein:

the at least one photosensitive drum comprises a plurality of photosensitive drums;

the photosensitive drum holding body holds the plurality of photosensitive drums; and the antistatic member is provided on a downstream side with respect to a contact position between the sheet-like medium and a downstream-most photosensitive drum of the plurality of photosensitive drums.

17. The image forming apparatus according to claim 14, wherein:

the antistatic member is a self-discharge type antistatic unit; and the second roller is a metal roller having an insulation layer on a surface of the second roller, and a metal part of the second roller is grounded.

18. The image forming apparatus according to claim 17, wherein:

the at least one photosensitive drum is electrically connected to the main body via an earth member provided in the photosensitive drum holding body;

a drum cleaning unit configured to collect toner remaining on the at least one photosensitive drum is provided in the photosensitive drum holding body;

a bias member electrically connected to the main body is provided in the drum cleaning unit, wherein a reverse polarity voltage with respect to a polarity voltage of the toner is applied to the bias member; and the self-discharge type antistatic unit is electrically connected to one of the earth member and the bias member.

19. The image forming apparatus according to claim 14, wherein the main body comprises a front cover, the front cover being disposed at an opposite side of the antistatic member with respect to the frame member, the front cover being configured to open and close an opening of the main body, and wherein the photosensitive drum holding body is detached from the main body by being drawn through the opening in a state where the opening is opened.

20. The image forming apparatus according to claim 14, further comprising:

a contact point attached to the main body and grounded; and a metal frame constituting the photosensitive drum holding body, wherein:

the antistatic member is electrically connected to the metal frame, and when the photosensitive drum holding body is attached to the main body, the contact point and the metal frame are electrically connected with each other, and the antistatic member is grounded via the contact point and the metal frame.

* * * * *